US005511310A

United States Patent [19]

Sessions et al.

[11] Patent Number: 5,511,310

[45] Date of Patent: Apr. 30, 1996

[54] FOLDING KNIFE

[75] Inventors: George C. Sessions, Milwaukie; Bradford J. Parrish, Oregon City, both of Oreg.

[73] Assignee: Fiskars Inc., Madison, Wis.

[21] Appl. No.: 430,235

[22] Filed: Apr. 28, 1995

Related U.S. Application Data

[63] Continuation of Ser. No. 27,298, Aug. 18, 1994, Pat. No. Des. 366,408.

[51] Int. Cl.[6] ..... B26B 1/04

[52] U.S. Cl. ..... 30/161; 30/155

[58] Field of Search ..... 30/155, 158, 159, 30/160, 161, 330; D8/98, 99

[56] References Cited

U.S. PATENT DOCUMENTS

| | | | |
|---|---|---|---|
| D. 299,413 | 1/1989 | DeCarolis | D8/99 |
| D. 348,818 | 7/1994 | Hesagawa | D8/99 |
| 4,265,017 | 5/1981 | Collins | 30/162 |
| 4,327,465 | 5/1982 | Moritsch . | |
| 4,347,665 | 9/1982 | Glesser | 30/161 |
| 4,570,341 | 2/1986 | Konneker | 30/161 |
| 4,578,864 | 4/1986 | Hoffman | 30/161 |
| 4,949,457 | 8/1990 | Burout, III | 30/85 |
| 5,111,581 | 5/1992 | Collins | 30/161 |
| 5,131,149 | 7/1992 | Thompson et al. | 30/161 |
| 5,400,509 | 3/1995 | Collins | 30/161 |

OTHER PUBLICATIONS

1995 Gerber® Outdoor Recreational Equipment Catalog at p. 15.

*Primary Examiner*—Hwei-Siu Payer
*Attorney, Agent, or Firm*—Foley & Lardner

[57] ABSTRACT

A foldable hand tool, such as a pocket folding knife, includes a knife blade and a handle for storing the knife blade, and a pivotally biased lock bar to secure the blade in extended position. The knife also includes a pair of non-slip ridges mechanically interlocked with the handle in a region of the handle proximate to the blade when the blade is in stored position. The ridges, which project outwardly from the handle, are contoured to permit suitable engagement by the fingertips of a user's hand, thereby reducing slippage when the blade is extended from the stored position. The handle is formed of two keyed sections firmly assembled together by cooperation of a lock bar biasing spring with coaxially aligned holes formed in the keyed regions of the handle sections.

22 Claims, 5 Drawing Sheets

FOLDING KNIFE

CROSS-REFERENCE TO THE RELATED APPLICATIONS

This is a continuing application of U.S. patent application Ser. No. 29/027,298 filed Aug. 18, 1994, now U.S. Pat. Des. No. 366,408.

FIELD OF THE INVENTION

The present invention relates generally to pocket tools, such as knives, having a handle and a working portion wherein the working portion is housed within the handle when the tool is not in use.

BACKGROUND OF THE INVENTION

Pocket tools, such as pocket knives, are widely used. For convenience and to prevent injury to the user, pocket knives are commonly provided with a handle and a blade which can be safely received within the handle to form a compact assembly when not in use. Prior art pocket knives generally comprise two kinds, namely those provided with a retractable blade, and those of the foldable blade type. An example of a retractable blade pocket knife is illustrated in U.S. Pat. No. 4,265,017 issued May 5, 1981 to Collins. The handle of that retractable blade knife is formed of two substantially identical halves joined together to form a cavity in which the retractable blade is received when the knife is not in use. The handle halves are held together by suitable fasteners such as deformable pins, which cooperate with a generally U-shaped bolster. To use the knife, the user must manipulate the blade to move it into the fully extended position. As can readily be appreciated from the foregoing, a pocket knife of this type has several short comings. In particular, it requires the user to manipulate the tip and sharpened regions of the blade to extend the blade before use. In addition to comprising numerous parts, such a knife also requires the use of unsightly pins and a bolster to maintain the two halves of the handles in cooperative engagement. To overcome some of these short comings, pocket knives with retractable blades have been provided with a sliding mechanism that can be activated by the user thereby avoiding direct contact with the blade. However, such a mechanism, which also typically comprises various components, necessarily protrudes from the surface of the knife handle thereby interfering with proper and comfortable gripping of the knife.

Problems associates with retractable-blade pocket knives have already been recognized and variously addressed by those skilled in the art, using among other things the benefits provided by certain pocket knives with foldable, as opposed to retractable, blades. As one of the most recent examples of a foldable blade pocket knife, U.S. Pat. No. 5,400,509 issued Mar. 28, 1995 to Collins discloses a folding knife having a unitary plastic handle configured to accommodate a blade carrier frame designed to receive the folded blade. To expose the blade, the user, nesting the handle in one hand, engages the finger notch formed near the upper edge of the blade, typically with the thumb nail of the other hand. Although the unitary handle permits the elimination of pins or other fasteners that might otherwise be flush with, and visible on, the faces of the handle, this concept requires the use of an additional component, thereby increasing the number of steps of the assembly process. Furthermore, under certain circumstances such as when the hands of the user are wet, the plastic handle may tend to escape from its nested position in the user's hand, as the user pulls on the upper edge of the blade to open the knife. As one way to overcome this undesirable slippage, handles of folding knives are often coated with a non-slip material such as rubber. Commercially available folding knives provided with non-slip coating are for example those marketed by the assignee of the present invention under the Stallion brand name, as shown at page 15 of the assignee's 1995 catalog. However, over time under certain conditions of use, the rubber coating may start peeling off the handle, thereby reducing its effectiveness and detracting from the overall appearance of the knife.

Another concept used to facilitate the opening of the blade of a folding knife is disclosed in U.S. Pat. No. 4,347,665 issued Sep. 7, 1982 to Glesser. As disclosed in Glesser, the hole formed in the enlarged upper region of the blade is engageable by the user's thumb, thereby allowing the user to open the blade with a single hand, and without making eye contact with the knife. However, to prevent the knife from slipping out of the user's hand, the user will typically have to apply lateral pressure on the knife handle with the tips of the other fingers of the hand holding the knife. In the case of the knife disclosed in the Glesser patent, the user will most likely rest those fingertips on the edge of the pocket clip for more positive retention of the knife within the hand.

The limitations identified in the foregoing make apparent that prior art pocket tools such as pocket knives or the like, have various disadvantages. Some of these prior art items include a blade actuating mechanism comprising several components assembled within the handle using various fasteners, such fasteners and mechanism being apparent on the faces of the knife handle thereby detracting from the overall appearance of these knives and impairing their ergonomic characteristics. On the other hand, the various prior art attempts to limit slippage of a pocket knife handle out of the user's hand during unfolding of the blade, for the reasons explained in the foregoing, have not been fully satisfactory. Thus, it appears desirable to provide foldable pocket knives or the like with improved features to attempt to alleviate the problems associated with conventional prior items, but which are nonetheless engineered to facilitate their fabrication, at the same time improving, or at least maintaining, their reliability and relatively low cost.

SUMMARY OF THE INVENTION

A pocket folding knife according to the present invention includes a blade pivotally connected to a handle within which the blade may be received. According to one aspect of the invention, the knife handle includes non-slip regions particularly in the form of ridges interlocked with the handle; the ridges are engageable by the fingertips of the user's hand when the blade is being unfolded in a one handed operation.

According to another aspect of the invention, the handles comprises two substantially identical sections made of a moldable material such as plastic to which ergonomically contoured ridges, made of a flowable non-slip material, are interlocked in a secondary operation. The regions of the handle sections where the ridges are connected are formed with a series of apertures and adjoining inner recessed areas designed to permit the flowable material to expand into, and conform with, those apertures and recesses to attach firmly each non-slip ridge to a respective handle section.

According to a preferred embodiment of the invention, the inner faces of the handles are also provided with keyed protrusions. The knife also includes a spring-biased lock bar to lock the blade in extended position. The lock bar is biased by a spring which also serves to interlock the keyed protrusions, thereby maintaining the handle assembled. A folding knife according to the invention comprises a limited number of components facilitating its assembly, and reduces slippage during one handed opening of the blade, making such a knife more comfortable and easier to use.

BRIEF DESCRIPTION OF THE DRAWINGS

The preferred exemplary embodiment of the invention will hereinafter be described in conjunction with the appended drawings, wherein like numerals denote like elements and.

DETAILED DESCRIPTION OF A PREFERRED EXEMPLARY EMBODIMENT

The invention relates to pocket tools having a handle and a working portion wherein the working portion is foldable within the handle when the tool is not in use. Accordingly, the term "folding knife" as used herein from time to time should also be understood to connote other types of foldable implements such as files, hand saws, etc., while the use of the term "rubber-like" material further comprehends similar materials including, for example, Kraton® from Shell Oil Company of New York, N.Y., Santoprene® from Advanced Elastomer Systems Inc. (formerly Monsanto Company of St. Louis, Mo.), or other suitable material which can be utilized to form the ridges on the handles of the knife. In this vein, those skilled in the art will further appreciate that the device described herein and its principle of operation, as well as the method described herein for manufacturing such items and its principles of implementation, is broadly applicable to a wide variety of foldable implements generally, and may be adapted to tools other than knives. Accordingly, while the present invention is hereinafter described with particular reference to a folding knife, the skilled artisan will note its many other applications.

Figure 1:
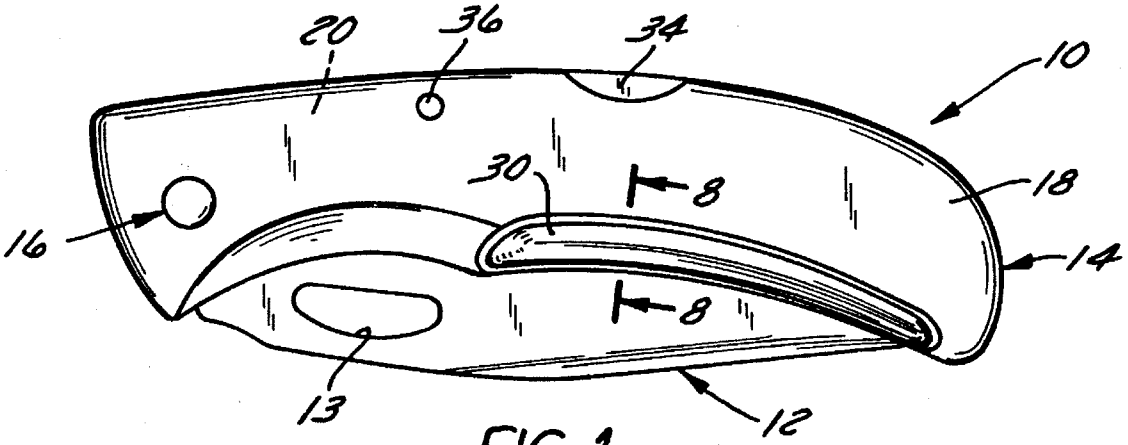
FIG. 1 is a front elevational view of a Folding Knife in accordance with the invention, with the blade shown in folded configuration.
Figure 2:
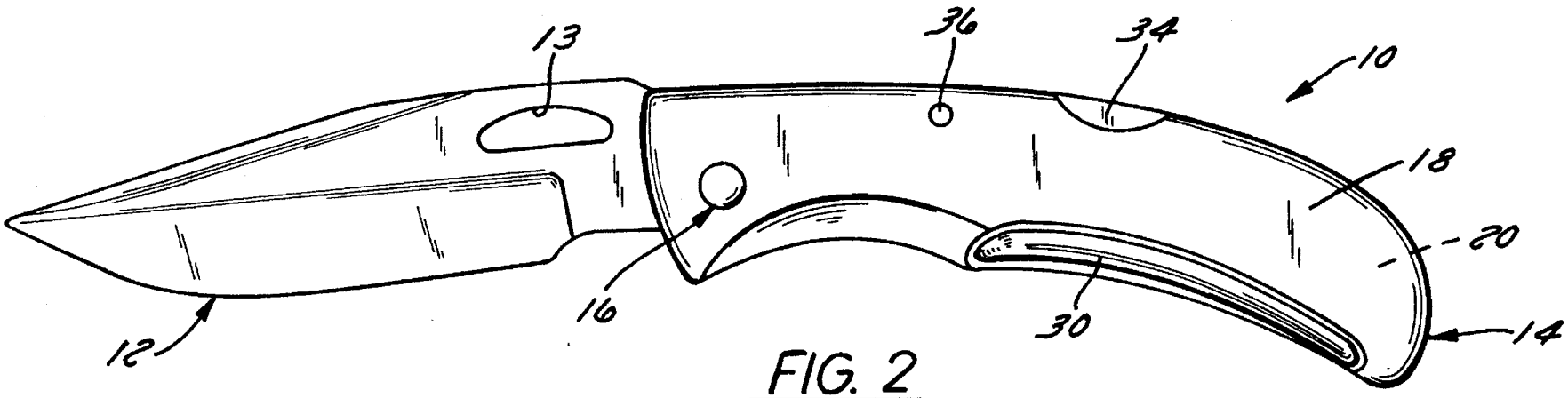
FIG. 2 is a front elevational view of the Folding Knife of FIG. 1 shown with the blade in the open position.
Figure 7:
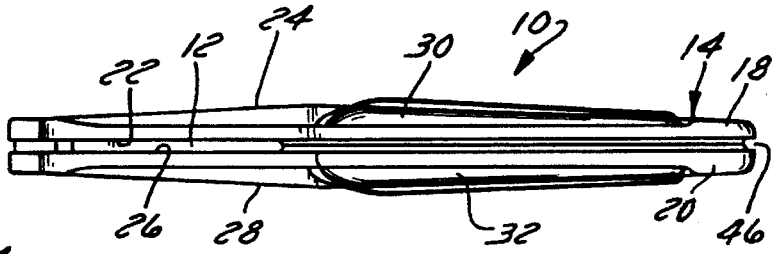
FIG. 7 is a bottom plan view of the Folding Knife shown in FIG. 5.

Referring to the Figures, a folding knife 10 according to the invention includes a blade 12 pivotally connected to a handle 14 about a pivot 16. Referring more particularly to FIGS. 9–12, handle 14 is formed of two sections 18, 20, each section having oppositely facing inner and outer surfaces 22, 26, and 24, 28, respectively. As will be explained in greater detail below, in accordance with the present invention, folding knife 10 is also provided with a pair of non-slip ridges 30, 32, (shown more particularly on FIGS. 7, 8, and 13) formed on both sides of handle 14 in regions proximate to blade 12 when blade 12 is in stored position as shown in FIG. 1.

Figure 3:
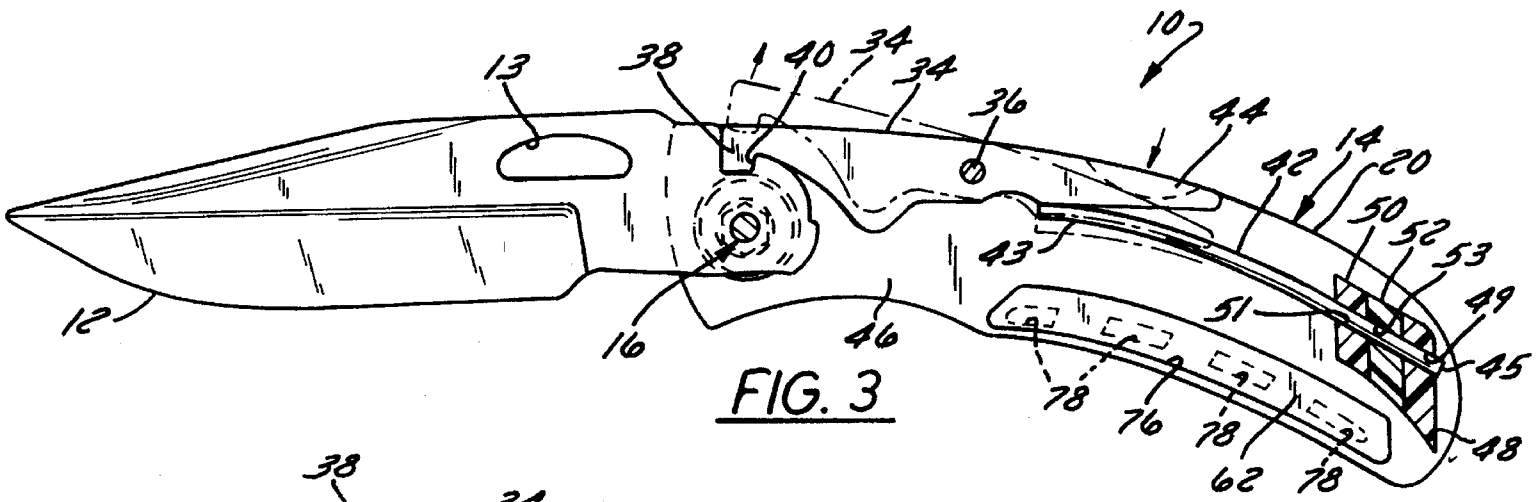
FIG. 3 is a sectional view of the Folding Knife of FIG. 2 taken along the longitudinal axis thereof.
Figure 4:
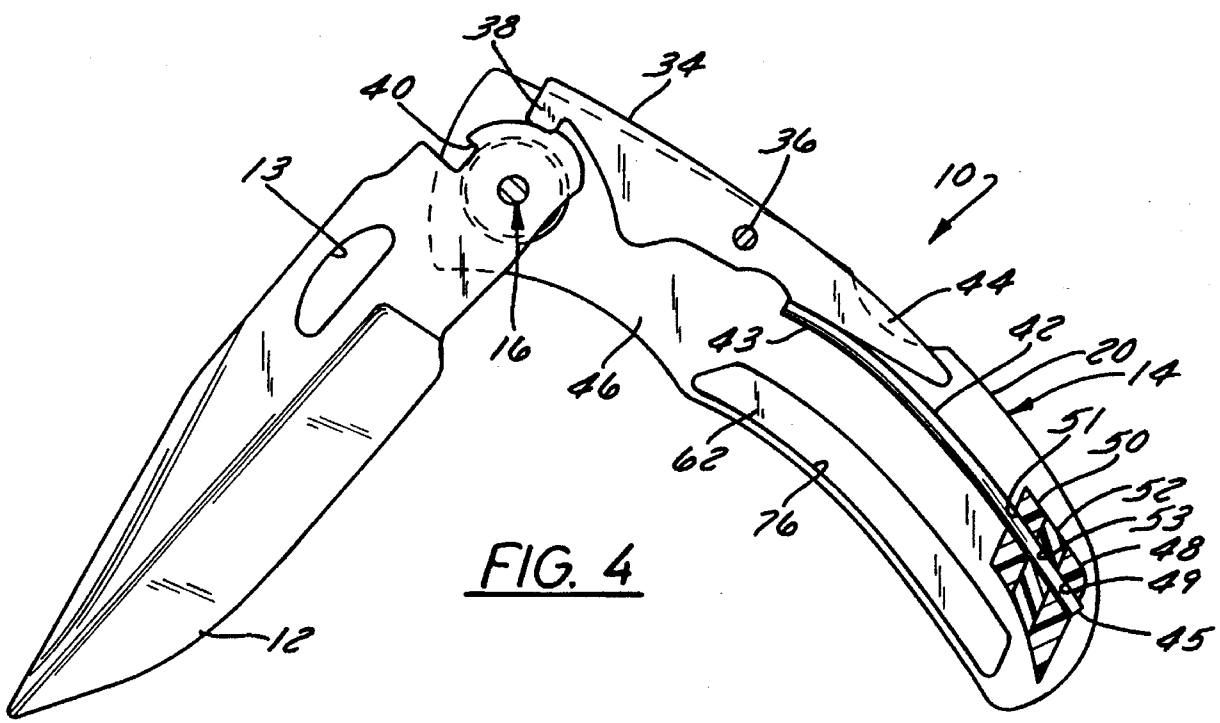
FIG. 4 is a sectional view of the Folding Knife of FIG. 2 taken along the longitudinal axis thereof and showing the blade in semi-folded position.
Figure 5:
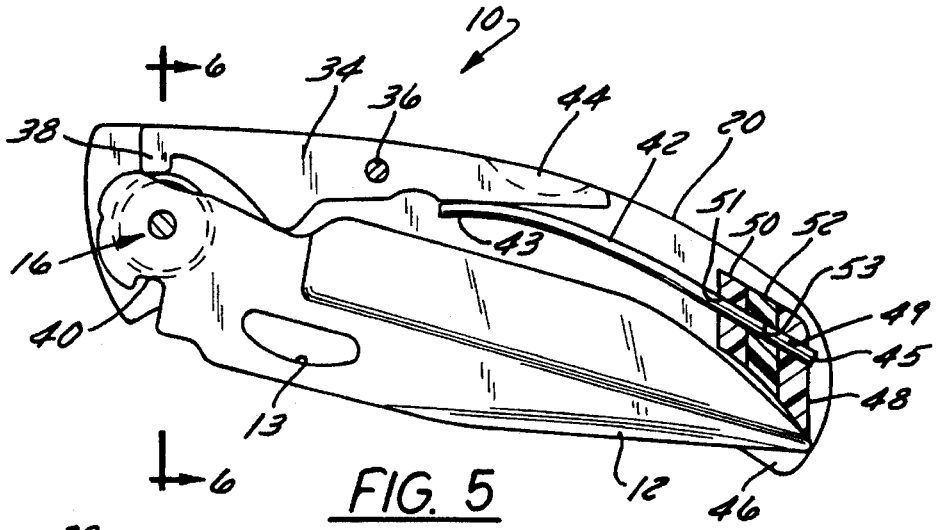
FIG. 5 is a sectional view of the Folding Knife of FIG. 3 taken along the longitudinal axis thereof showing the blade in the folded position.
Figure 6:
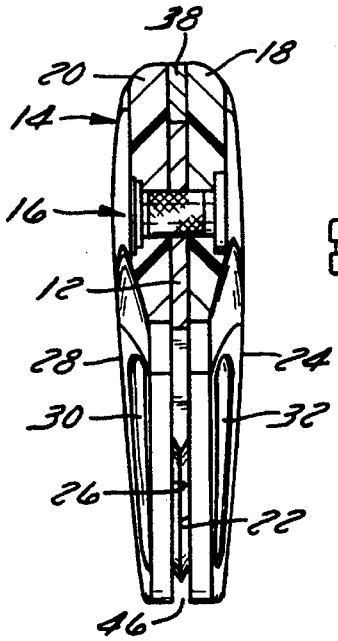
FIG. 6 is a sectional view taken along line 6—6 shown in FIG. 5.

As in most commercially available folding knives, knife 10 further comprises a lock bar 34 which is pivotally connected to handle 14 by means of a pivot pin 36, which is preferably knurled for a more positive engagement of pin 36 with handle 14. Lock bar 34 is designed to pivot around pin 36 between first and second positions. In the first position, which is represented in solid lines in FIG. 3, catch 38 of lock bar 34 is received in a conforming recess 40 in the tang portion of blade 12 thereby locking blade 12 in extended position. Lock bar 34 is biased toward the first position, so that catch 38 is retained in recess 40 under the action of an elongated spring 42 removably secured to handle 14. To store blade 12 within handle 14, the user will push down distal end 44 of lock bar 34 moving lock bar 34 to its second position (as shown in dashed lines in FIG. 3), sufficiently to overcome the upwardly directed biasing force exerted by spring 42 on distal end 44, to free catch 38 out of recess 40 and permit rotation of blade 12 to its stored position. The user can again bring blade 12 to its fully extended position by holding knife 10 in one hand and inserting the thumb of the hand holding the knife into an opening 13 formed through blade 12 in a region of blade 12 proximate pivot 16.

Referring now more particularly to FIGS. 3–5 13 and 14, and in accordance with one aspect of the present invention, spring 42 having a free end 43 (resiliently opposing distal end 44 of lock bar 34) and a distal end 45, is also preferably used to keep handle sections 18 and 20 assembled together. When sections 18 and 20 are assembled, inner surfaces 22 and 26 are configured so as to be spaced apart to form a cavity 46 adapted to receive blade 12 in stored position. Handle sections 18 and 20 are advantageously manufactured by an injection molding process such as plastic molding, in which the gating can be located on inner surfaces 22, 26 because handle 14 is made of two separate sections. Handle sections 18, 20 are advantageously made of hard molded fiberglass reinforced nylon to improve durability and strength of the knife, without adversely affecting its weight.

Figure 14:
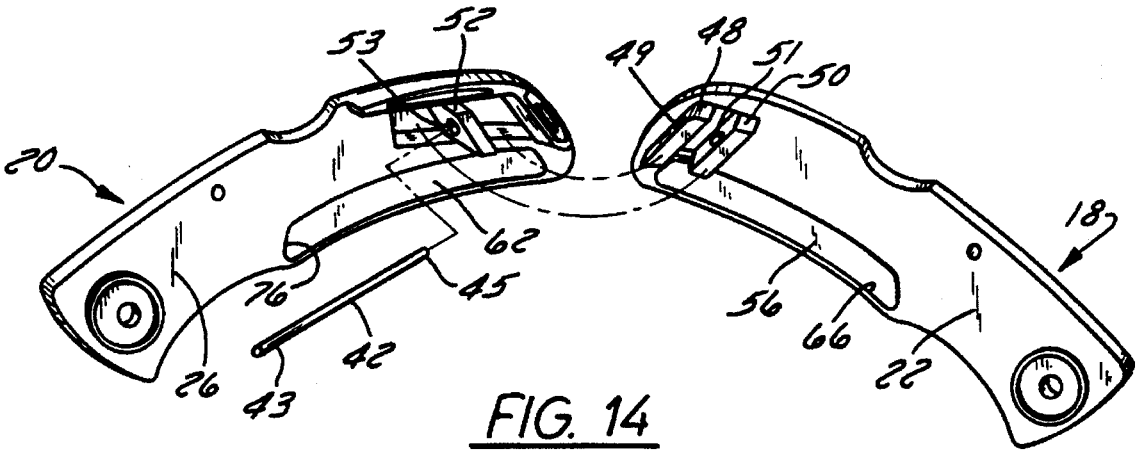
FIG. 14 is an exploded perspective view of the handle sections shown in FIGS. 9–12 showing the engagement of the elongated spring when the handle sections are brought together as shown in FIG. 13.

As shown in FIG. 14, handle section 18 has a pair of projections 48, 50, formed in the rear region of section 18 and extending from inner surface 22 by a predetermined distance. On the other hand, handle section 20 has a single projection 52 formed in the rear region of section 20 and extending from inner surface 26 by a predetermined distance. Projections 48, 50, and 52 have holes therethrough, respectively 49, 51, and 53, configured to become coaxially aligned when handle sections 18, 20 are brought together to form handle cavity 46. Accordingly, when handle sections 18, 20 are brought together toward that end, projection 52 is keyed between projections 48 and 50, aligning as a result handles sections 18 and 20, thereby facilitating the subsequent assembly of the other components of the knife. To maintain handle sections 18, 20 in assembled relationship, distal end 45 of spring 42 is removably inserted into holes 51, 53, and 49, interlocking sections 18 and 20. Spring 42 is maintained in interlocking position by its own spring force as, when knife 10 is assembled, free end 43 of spring 42 is, at all times, deflected by distal end 44 of lock bar 34. If desired, however, the force maintaining spring 42 in place can be increased by a slight offset of holes 51, 53, and 49, in the order of 0.002" center to center. Alternatively, end 45 could be knurled, although this would increase the cost of spring 42.

It can therefore be readily appreciated from the foregoing that the cooperation of keyed projections 48, 50, and 52 interlocked by spring 42 conveniently eliminates the need to use pins or other fasteners to keep handle sections 18 and 20 firmly assembled. It should also be noted that since spring 42 removably engages holes 49, 51, and 53, knife 10 can be easily disassembled for cleaning and lubricating in the event it came into contact with certain chemicals or after its use under certain conditions that might otherwise affect its performance. The dual function of spring 42, used to bias lock bar 34 as well as to interlock handle sections 18 and 20, permits a reduction in the number of components of a folding knife, thereby facilitating its assembly and most likely increasing its reliability. Furthermore, as will be seen below, the fact that handle 14 is formed of two independent sections 18, 20 provides other advantages which will facilitate attachment of ridges 30, 32 to handle 14.

Referring now more particularly to FIGS. 1, 7, 8, and 13, as noted above, handle 14 is also provided with elongated ridges 30, 32 made of a non-slip material. Ridges 30, 32, are mechanically interlocked with handle 14 in regions proximate to blade 12 when blade 12 is in stored position as shown in FIG. 1. In the preferred embodiment of the present invention, ridges 30, 32 are formed by molding a rubber-like material such as Kraton® or Santoprene® onto handle sections 18, 20, respectively. Those skilled in the art of molding parts will readily appreciate that to form ridges 30, 32 onto handle 14 in a convenient and economical manner requires that handle 14 is not made of a single piece.

Figure 8:
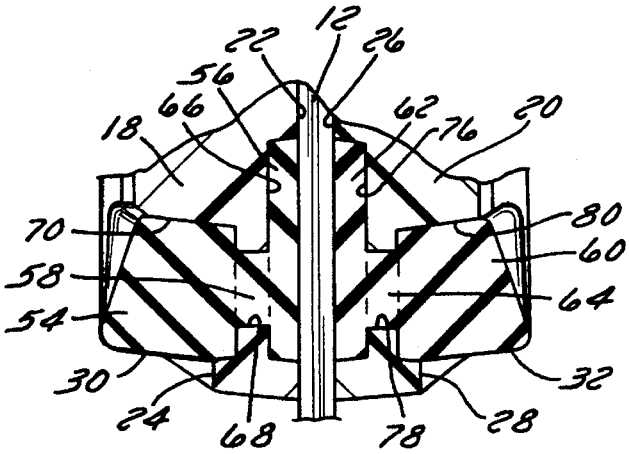
FIG. 8 is a partial sectional view taken along line 8—8 shown in FIG. 1.

As a shown in FIG. 8, ridge 30 comprises an engageable portion 54 and a retaining portion 56 joined to engageable portion 54 by an intermediate portion 58. Similarly, ridge 32 comprises an engageable portion 60 and a retaining portion 62 joined to engageable portion 60 by an intermediate portion 64. Since ridges 30, 32, are preferably unitary pieces made of moldable material such as rubber, engageable portions 54, 60, respectively merge into intermediate portions 58, 64, which in turn merge into retaining portions 56, 62.

Figure 10:
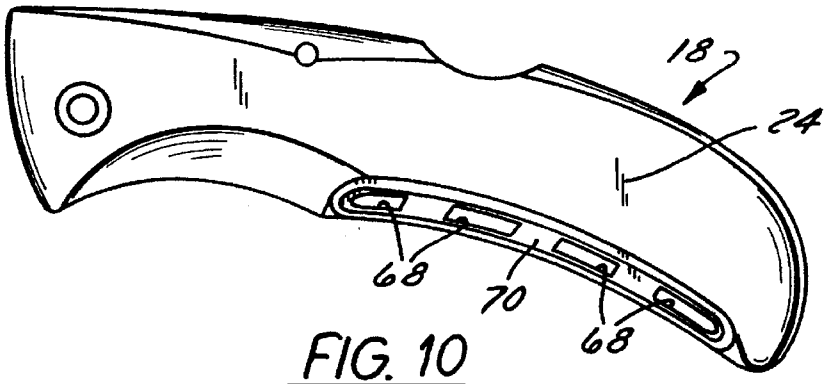
FIG. 10 is a front elevational view of a second handle section of the Folding Knife of FIG. 1.
Figure 12:
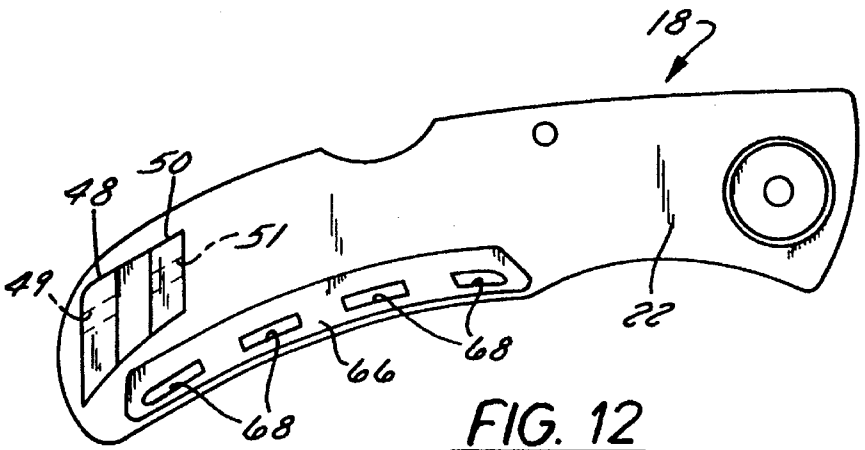
FIG. 12 is a rear elevational view of the handle section of FIG. 10.
Figure 13:
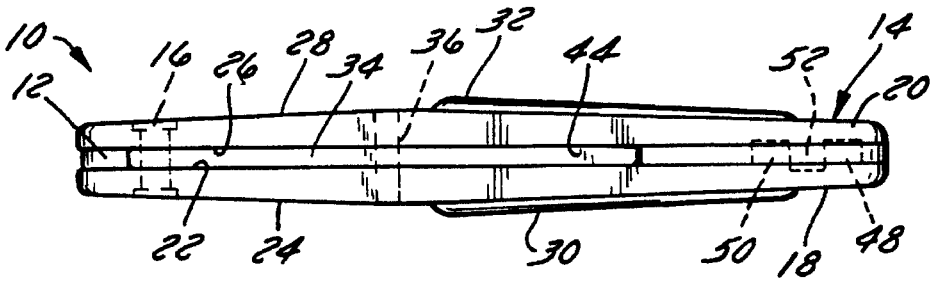
FIG. 13 is a top plan view of the assembled handle sections shown in FIGS. 9–12.

To interlock ridge 30 with handle section 18, as shown in FIGS. 10 and 12, handle section 18 comprises an elongated recessed area 66 formed in inner surface 22 in a lower region thereof which is proximate to blade 12 when blade 12 is received in cavity 46. To firmly position ridge 30 with respect to handle section 18, several apertures generally designated as 68 are formed along recessed area 66, extending to outer surface 24 of handle section 18. Similarly, an elongated cavity 70 can be formed in outer surface 24 to increase the positional retention of ridge 30 with respect to handle section 18.

Figure 9:
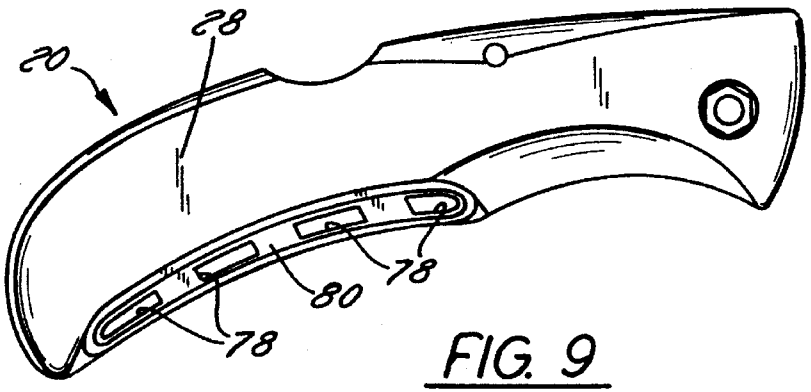
FIG. 9 is a front elevational view of a first handle section of the Folding Knife of FIG. 1.
Figure 11:
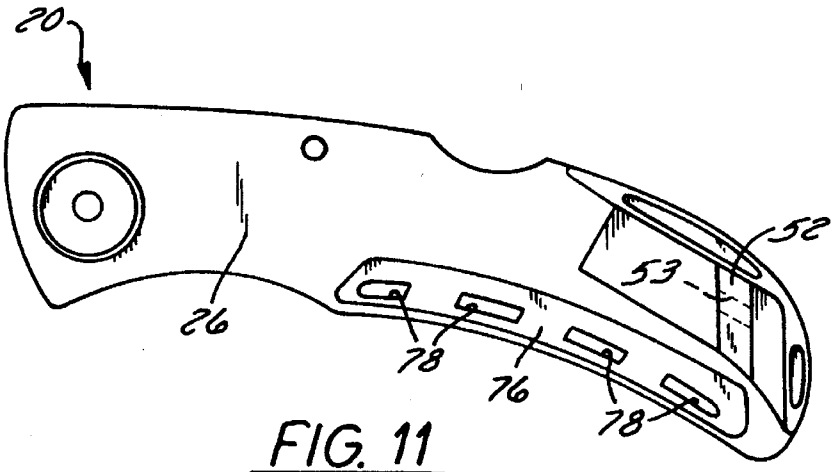
FIG. 11 is a rear elevational view of the handle section of FIG. 9.

In the same manner, to interlock ridge 32 with handle section 20, as shown in FIGS. 9 and 11, handle section 20 comprises an elongated recessed area 76 formed in inner surface 26 in a lower region thereof which is proximate to blade 12 when blade 12 is received in cavity 46. To firmly position ridge 32 with respect to handle section 20, several apertures generally designated as 78 are formed along recessed area 76, extending to outer surface 28 of handle section 20. Similarly, an elongated cavity 80 can be formed in outer surface 28 to increase the positional retention of ridge 32 with respect to handle section 20. Since according to the preferred embodiment of the present invention ridges 30, 32 are made of rubber-like material molded onto handle sections 18, 20, the rubber material will expand in, and closely conform with, recessed areas 66, 76, becoming effectively in contact with inner surfaces 22, 26; ridges 30, 32 will also pass through and closely conform with apertures 68, 78, extending into, and closely conforming with cavities 70, 80, to terminate at a predetermined distance from outer surfaces 24, 28.

It can therefore be readily appreciated from the foregoing description of the present invention that because ridges 30, 32 are provided with retaining portions 56, 62 connected to engageable portions 54, 60 by intermediate portions 58, 64 which are received and conform with apertures 68, 78 formed in handle sections 18, 20, ridges 30, 32 will as a result be interlocked with handle 14.

A foldable hand tool such as a pocket folding knife according to the present invention therefore alleviates some of the short comings found in the prior art and in particular improves retention of the knife within the hand of the user during one handed opening of the blade. The pair of ridges used toward that end which are ergonomically contoured also improve user comfort during normal use of the knife. Furthermore, the dual function of the biasing spring also permits elimination of unsightly fasteners. Thus, such novel features should facilitate assembly of such folding knives and also favorably affect other characteristics which are important to users of these knives.

It is understood that the above description is of a preferred exemplary embodiment of the invention, and that the invention is not limited to the specific forms described. Those skilled in the art will appreciate that, for example, foldable tools in accordance with the invention could comprise working portion other than a knife blade, as in a foldable saw or file, instead of a knife blade as described in the preferred embodiment. In such a case, the handle of the tool would be configured to suitably receive the saw or file when folded into a compact assembly. Furthermore, ridges 30, 32, could be secured to handle section 18, 20 in a manner other than that described in the foregoing, and could, depending on the application be of other configurations. Likewise, recessed areas 66, 76, and/or cavities 70, 80, could have different configurations, as required by the particular application, in each and every cases without departing from the scope of this invention. Such other configurations and constructions are considered to be within the scope of this invention. Thus, these and other substitutions, modifications, changes and omissions may be made in the design and arrangement of the elements and in the manufacturing steps disclosed herein without departing from the scope of the appended claims.

We claim:

1. A pocket folding knife comprising:

a knife blade;

a first handle section;

an opposed second handle section joined to the first handle section to form a handle having a cavity in which the blade is received when in stored position;

each handle section having a pair of oppositely facing inner and outer surfaces;

an elongated lock bar pivotally connected to the handle for movement between a first position in which the blade is locked in extended position, and a second position to permit pivotal movement of the blade to the stored position;

an elongated spring, biasing the lock bar into the first position, the spring having a free end effectively in contact with the lock bar and a distal end; and means for removably joining the handle sections wherein such means comprises the distal end of the elongated spring.

2. The folding knife of claim 1, wherein the handle sections have keyed projections extending from respective inner surfaces thereof, the distal end of the spring removably connecting the handle sections at the keyed projections.

3. The folding knife of claim 1, further including at least a ridge formed in a region of the handle proximate to the blade when the blade is in stored position, the ridge being mechanically interlocked with one of the handle sections and extending from the inner surface thereof to a point lying at a predetermined distance from the outer surface of the one of the handle sections.

4. The folding knife of claim 3, wherein the ridge is made of moldable material and comprises an engageable portion and a retaining portion joined to the engageable portion by an intermediate portion.

5. The folding knife of claim 4, wherein at least one of the handle sections has an elongated recessed area formed in the inner surface thereof along the region, and a plurality of apertures extending from the recessed areas to the outer surface of the one of the handle sections, and further wherein the retaining portion of the ridge substantially conforms with the recessed areas, the engageable portion extends to a point lying at a predetermined distance from the outer surface of the one of the handle sections, and the intermediate portion substantially conforms with the plurality of apertures.

6. A pocket folding knife comprising:

a knife blade;

a handle for storing the knife blade, the handle having oppositely facing inner and outer surfaces and a plurality of apertures formed through one of the outer surfaces to an inner surface respective to the one of the outer surfaces in a region of the handle proximate to the blade when the blade is in stored position; and a ridge extending from the inner surface respective to the one of the outer surfaces through the apertures and from the one of the outer surfaces by a predetermined distance.

7. The knife of claim 6, wherein the ridge is made of moldable material.

8. The knife of claim 7, wherein the moldable material is a rubber-like compound.

9. The knife of claim 6, further comprising a second plurality of apertures formed in the region of the handle through the other of the outer surfaces to a second inner surface respective to the other of the outer surfaces, and a second ridge extending from the second inner surface through the second plurality of apertures and from the other of the outer surfaces by a predetermined distance.

10. The folding knife of claim 9, wherein the handle comprises a pair of opposed handle sections, each section having an elongated recessed area formed in the region of the handle in the inner surface thereof, and wherein the apertures of a respective one of the handle sections extend from a respective one of the recessed areas to a respective one of the outer surfaces.

11. The knife of claim 6, wherein the ridge is ergonomically contoured to permit suitable engagement by fingertips of a user's hand holding the knife, thereby reducing slippage when the blade is extended from the stored position.

12. The knife of claim 6, wherein the blade further comprises an opening formed therethrough in a region of the blade proximate a pivot point between the blade and the handle, the opening being suitable for engagement by a user's thumb thereby permitting one-handed pivoting movement of the blade from the stored position.

13. The folding knife of claim 6, further comprising:

an elongated lock bar pivotally connected to the handle for movement between a first position in which the blade is locked in extended position, and a second position to release the blade and permit its pivoting movement to the stored position; and an elongated spring biasing the lock bar toward the first position, the spring having a free end effectively in contact with the lock bar, and a distal end removably connected to the handle.

14. The folding knife of claim 13, wherein the handle comprises a pair of opposed handle sections having keyed projections extending from the inner surfaces thereof, the distal end of the spring removably connecting the handle sections at the keyed projections to form a handle cavity receiving the blade when in stored position.

15. A pocket folding knife comprising:

a knife blade;

a handle having oppositely facing outer surfaces and spaced apart inner surfaces forming a handle cavity for storing the knife blade; and at least one ridge mechanically interlocked with the handle and effectively in contact with one of the inner surfaces in a region of the handle proximate to the blade when the blade is in stored position, the ridge projecting outwardly from a respective one of the outer surfaces by a predetermined distance.

16. The knife of claim 15, wherein the ridge is made of moldable rubber-like material.

17. The knife of claim 16, wherein an elongated recessed area is formed in the one of the inner surfaces along the region, and further wherein a plurality of apertures extend from the recessed area to the respective one of the outer surfaces, the ridge substantially conforming with the recessed area and with the apertures.

18. The knife of claim 15, further comprising a second ridge mechanically interlocked with the handle and effectively in contact with the other of the inner surfaces in the region of the handle, the second ridge projecting outwardly from the other of the outer surfaces by a predetermined distance.

19. The knife of claim 15, wherein the ridge is ergonomically contoured to permit suitable engagement by fingertips of a user's hand holding the knife, thereby reducing slippage when the blade is extended from the stored position.

20. The folding knife of claim 15, further comprising:

an elongated lock bar pivotally connected to the handle for movement between a first position in which the blade is locked in extended position, and a second position to release the blade and permit its pivoting movement to the stored position; and an elongated spring biasing the lock bar toward the first position, the spring having a free end effectively in contact with the lock bar, and a distal end removably connected to the handle.

21. The folding knife of claim 20, wherein the handle comprises a pair of opposed handle sections having keyed projections extending from the inner surfaces, the projections having holes therethrough configured to become coaxially aligned to receive the distal end of the spring when the handle sections are brought together to form the handle cavity.

22. A method for making a folding knife of the type including a blade and a handle, a pair of first and second opposed handle sections forming a handle cavity for storing the blade, a lock bar pivotally connected to the handle, a spring removably connecting the handle sections and biasing the lock bar to lock the blade in extended position, each handle section having oppositely facing inner and outer surfaces and a plurality of apertures formed therethrough in a region of the handle proximate to the blade when the blade is in stored position, each handle section further including a ridge mechanically interlocked with a respective handle section and extending therefrom by a predetermined distance, the method comprising the steps of:

molding the first and second handle sections;

molding the ridge onto each of the handle sections so that the ridge is effectively in contact with a respective one of the inner surfaces, extending through a respective one of the plurality of apertures, and projecting from a respective one of the outer surfaces by a predetermined distance;

bringing the handle sections together and inserting the spring into coaxially aligned holes of the handle sections to removably join the handle sections and form the handle cavity; and assembling the lock bar and blade.

* * * * *